US006230887B1

(12) United States Patent
Snider

(10) Patent No.: US 6,230,887 B1
(45) Date of Patent: May 15, 2001

(54) ARTICLE CARRIER

(75) Inventor: Gregory S. Snider, Bel Air, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/414,795

(22) Filed: Oct. 8, 1999

(51) Int. Cl.[7] ..... A45C 11/26
(52) U.S. Cl. ..... 206/349; 206/232; 206/372
(58) Field of Search ..... 206/232, 303, 206/320, 349, 372, 373; 190/102, 108, 111, 115; 150/117

(56) References Cited

U.S. PATENT DOCUMENTS 1,638,753 * 8/1927 Stein et al. .
3,533,459 * 10/1970 Ody .
4,153,092 * 5/1979 Haslam ..... 150/33
4,192,365 * 3/1980 Siegel ..... 150/35
4,236,559 * 12/1980 Archbold ..... 150/1.6
4,261,448 * 4/1981 Myers et al. ..... 190/115
4,287,971 * 9/1981 Doulet ..... 190/111
4,588,082 * 5/1986 Ridings ..... 206/349
4,739,809 * 4/1988 Adams ..... 150/112
4,921,153 * 5/1990 Smith ..... 224/253
5,018,609 * 5/1991 Brenner ..... 190/108
5,127,500 * 7/1992 Mitchell ..... 190/115
5,456,057 * 10/1995 Bannon et al. ..... 206/349
5,655,325 * 8/1997 Watkins ..... 40/617
5,692,608 * 12/1997 Simien ..... 206/320
5,769,212 * 6/1998 Collins ..... 206/38
5,771,537 * 6/1998 Ho ..... 16/125

* cited by examiner

*Primary Examiner*—David T. Fidei
(74) *Attorney, Agent, or Firm*—Harness, Dickey & Pierce, P.L.C.

(57) ABSTRACT

A carrier or case having a first body panel, a spacer panel and a second body panel to which at least one pocket member is coupled. The pocket member forms a pocket having an open end which is adapted to retain an article, such as a saw blade. The spacer panel is disposed between the first and second body panels. The spacer panel and first and second body panels are foldably interconnected in order to allow selective movement of the first and second body panels relative to the spacer panel between an open position and a closed position, wherein the first and second body panels are substantially parallel to each other and spaced apart a predetermined distance defined by the spacer panel and the first body panel covers at least a portion of the pocket member to retain the article in the pocket when the article carrier is placed in the closed position.

20 Claims, 4 Drawing Sheets

ARTICLE CARRIER

BACKGROUND OF THE INVENTION

1. Technical Field

The present invention relates generally to manually transportable pouches or cases for holding and carrying various articles or items, and more particularly to such portable pouches or cases having pockets, sleeves, dividers or other receptacles for receiving and carrying generally planar tool items, such as circular saw blades, and accessories therefore.

2. Discussion

Although a wide variety of portfolios, cases and other such containers have been devised for holding and organizing circular saw blades, these prior art carriers frequently have been found to be lacking in terms of the ease or convenience with which blades are stored or removed by the user. In addition, many of these carriers have been designed for a very specific application or for a narrow range of particular applications and have not been well suited for use in other applications. Still other carriers have been found to be too large or cumbersome for convenient transportation or use when the user is not restricted to a particular workstation.

A number of the above-mentioned prior art holders or carriers have been fabricated from a rigid plastic material as a generally clam-shaped structure. Several of these devices have very limited storage capacity and as such, frequently necessitates the use of several of such cases to store a user's repertory of blades. Often times, these cases are not conducive to storing the blades in a manner which permits them to be readily removed from the case. Other cases do not sufficiently confine the blades and permit the edges of the blades to rattle against one another or against any tools which may be stored with the blades. The rattling of the blades against one another often dulls portions of the blades, necessitating that the blade be prematurely resharpened or scrapped. This problem is particularly costly when the blades are tipped with carbide since carbide tipped blades are frequently expensive to both purchase and resharpen and because carbide is brittle and may be easily cracked, thus increasing the likelihood of damage to these blades as compared to blades made from high speed steel.

Accordingly, the present invention seeks to address these concerns by providing a folding pouch-type carrier or case that is adapted to store blades in a confined manner to prevent them from being damaged during the use or transport of the case. The present invention also addresses these concerns by providing a folding case that may be conveniently and easily mounted to a wide variety of external mounting members or structures present at a worksite. The preferred case is also adapted for conveniently holding, storing and transporting other small articles such as blade wrenches.

SUMMARY OF THE INVENTION

In a preferred embodiment, the carrier or case includes a first body panel, a spacer panel and a second body panel to which at least one pocket member is coupled. The pocket member forms a pocket having an open end which is adapted to retain an article, such as a saw blade. The spacer panel is disposed between the first and second body panels. The spacer panel and first and second body panels are foldably interconnected in order to allow selective movement of the first and second body panels relative to the spacer panel between an open position and a closed position, wherein the first and second body panels are substantially parallel to each other and spaced apart a predetermined distance defined by the spacer panel and the first body panel covers at least a portion of the pocket member to retain the article in the pocket when the article carrier is placed in the closed position.

Additional advantages and features of the present invention will become apparent from the subsequent description and the appended claims, taken in conjunction with the accompanying drawings.

DETAILED DESCRIPTION OF THE PREFERRED EMBODIMENT

Figure 1:
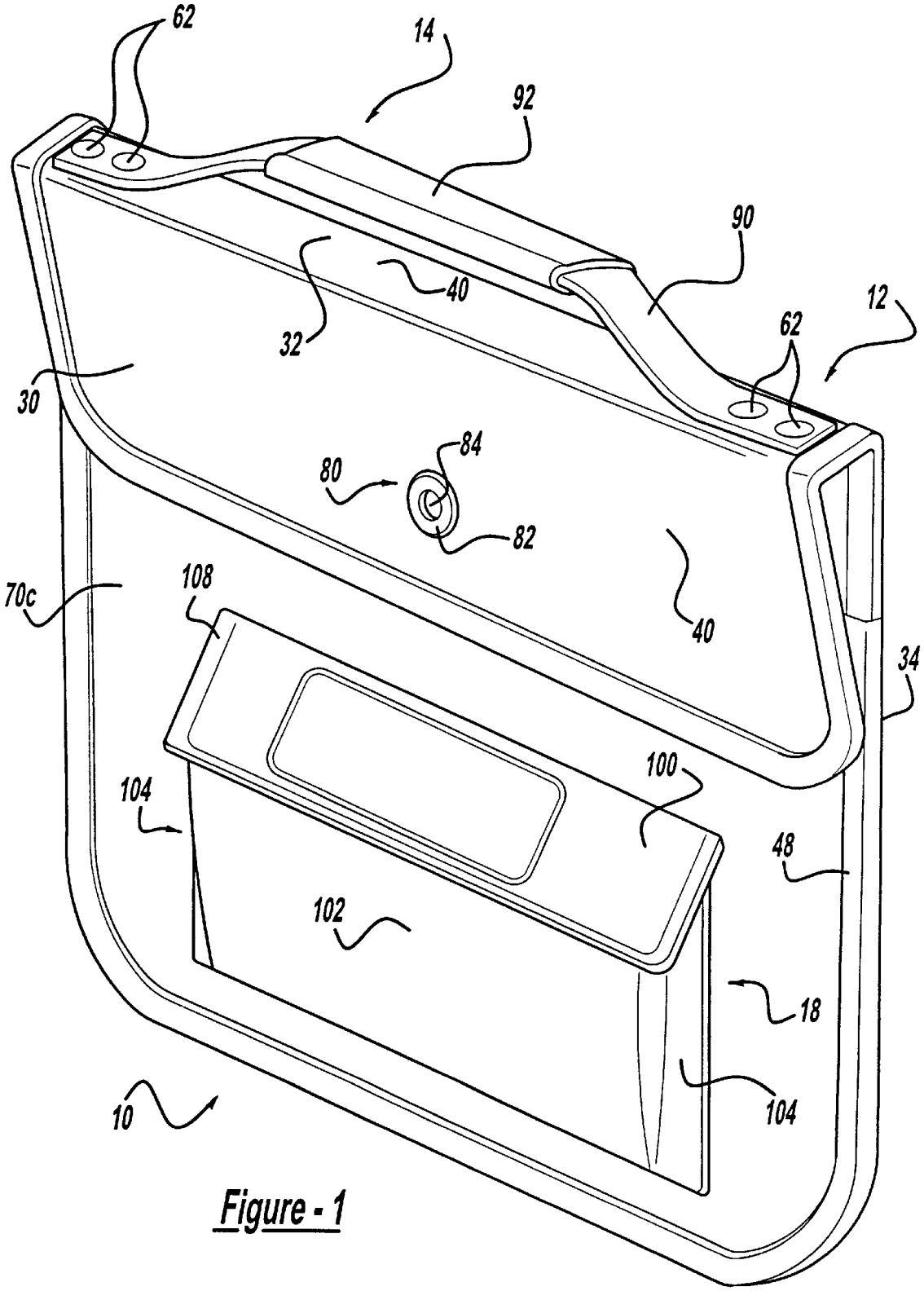
FIG. 1 is perspective view of an exemplary case constructed in accordance with the teachings of the present invention.

Referring to FIGS. 1 through 4, an exemplary case constructed in accordance with the teachings of the present invention is generally indicated by reference numeral 10. Case 10 is shown to include a body portion 12, a handle portion 14, a plurality of first pouches 16, a second pouch 18 and a third pouch 20. Case 10 is particularly well suited and adapted for carrying circular saw blades and accessories therefore, or even other types of items. Upon reviewing the following discussion in conjunction with the accompanying drawings, one skilled in the art will readily recognize that the present invention is equally applicable to pouches or article carriers of other configurations, as well as those adapted for specific applications other than that of the illustrated embodiment.

Figure 3:
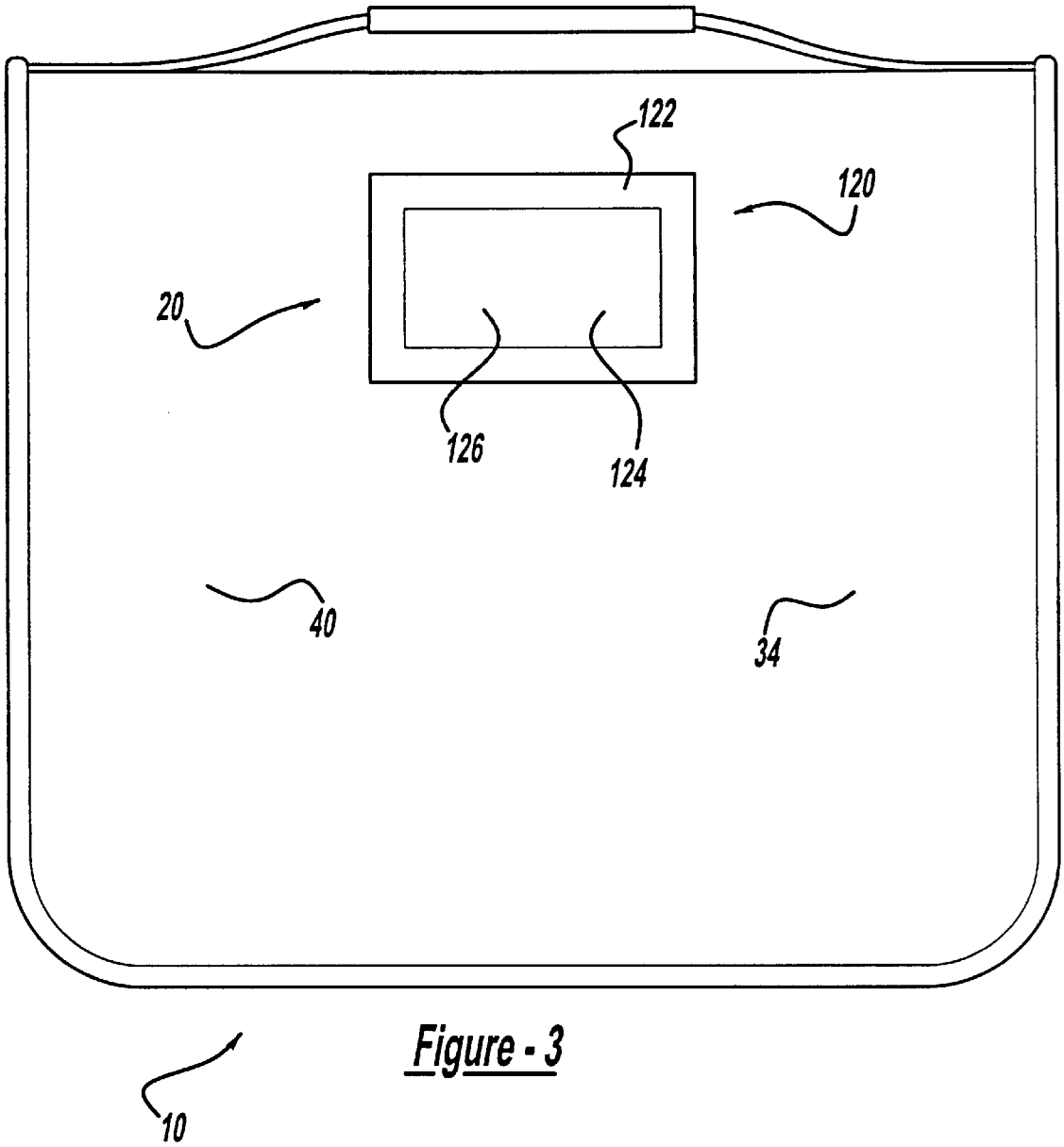
FIG. 3 is a rear view of the case of FIG. 1.
Figure 4:
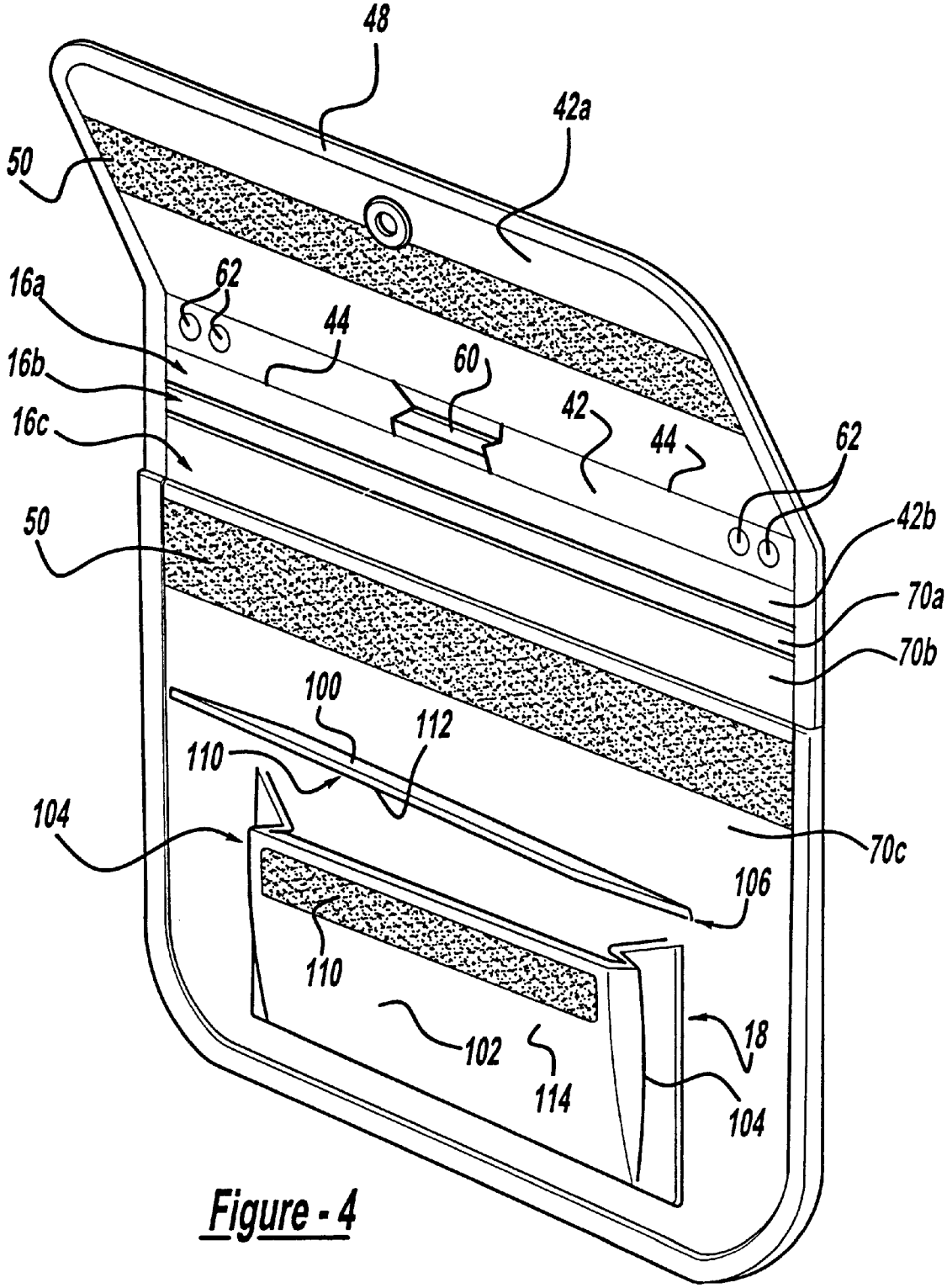
FIG. 4 is a perspective view of the case of FIG. 1 in an open condition.

With specific reference to FIGS. 1, 3 and 4, body portion 12 is shown to include a closure panel 30, a spacer panel 32 and a rear panel 34, all of which interconnect in a foldable configuration allowing case 10 to be folded between a closed configuration as illustrated in FIG. 1 and an open configuration as illustrated in FIG. 4. In the particular embodiment illustrated, closure panel 30, spacer panel 32 and rear panel 34 each include an outer surface 40 formed from a polyolefin and an inner surface 42 formed from suede. Preferably, each of the outer and inner surfaces 40 and 42 are continuous from one panel to the next throughout each side of case 10, thus allowing outer and inner surfaces 40 and 42 to be stitched together along their sides to form living hinges along the abutting edges of the panels. In order to provide a neat appearance and increased durability, the non-abutting edges of the panels are banded by an edging fabric 48 which is composed of nylon, imitation nylon or other suitable and durable nylon-type fabric materials.

A quick-release fastener 50 is provided on the inner surfaces 42*a*, 42*b* of closure panel 30 and rear panel 34, respectively to permit case to be releasably retained in its closed configuration. Quick-release fastener 50 is illustrated as being a hook-and-loop type fastener assembly but may also be any other fastener, such as a snap-type fastener.

Spacer panel 32 maintains the closure panel 30 and the rear panel 34 in a spaced-apart, generally parallel relationship when case 10 is in its closed configuration. Spacer panel 32 is preferably sized to provide for the additional internal volume that results when articles are inserted into the first pouches 16. Spacer panel 32 includes a stiffener member 60 which is preferably formed from a plastic material. Construction in this manner provides spacer panel 32 with sufficient rigidity to permit spacer panel 32 and handle portion 14 to be coupled directly to one another through a plurality of rivets 62.

First pouch 16*a* is formed between a pouch member 70*a* and the inner surface 42*b*. First pouch 16*b* is formed between pouch members 70*a* and 70*b*. First pouch 16*c* is formed between pouch members 70*b* and 70*c*. Each of the pouch members 70 are generally planar, relatively thin and highly flexible. In the example provided, the front and rear surfaces of pouch members 70*a* and 70*b* and the rear surface of pouch member 70*c* are covered with suede while the front surface of pouch member 70*c* is covered with polyolefin.

Figure 2:
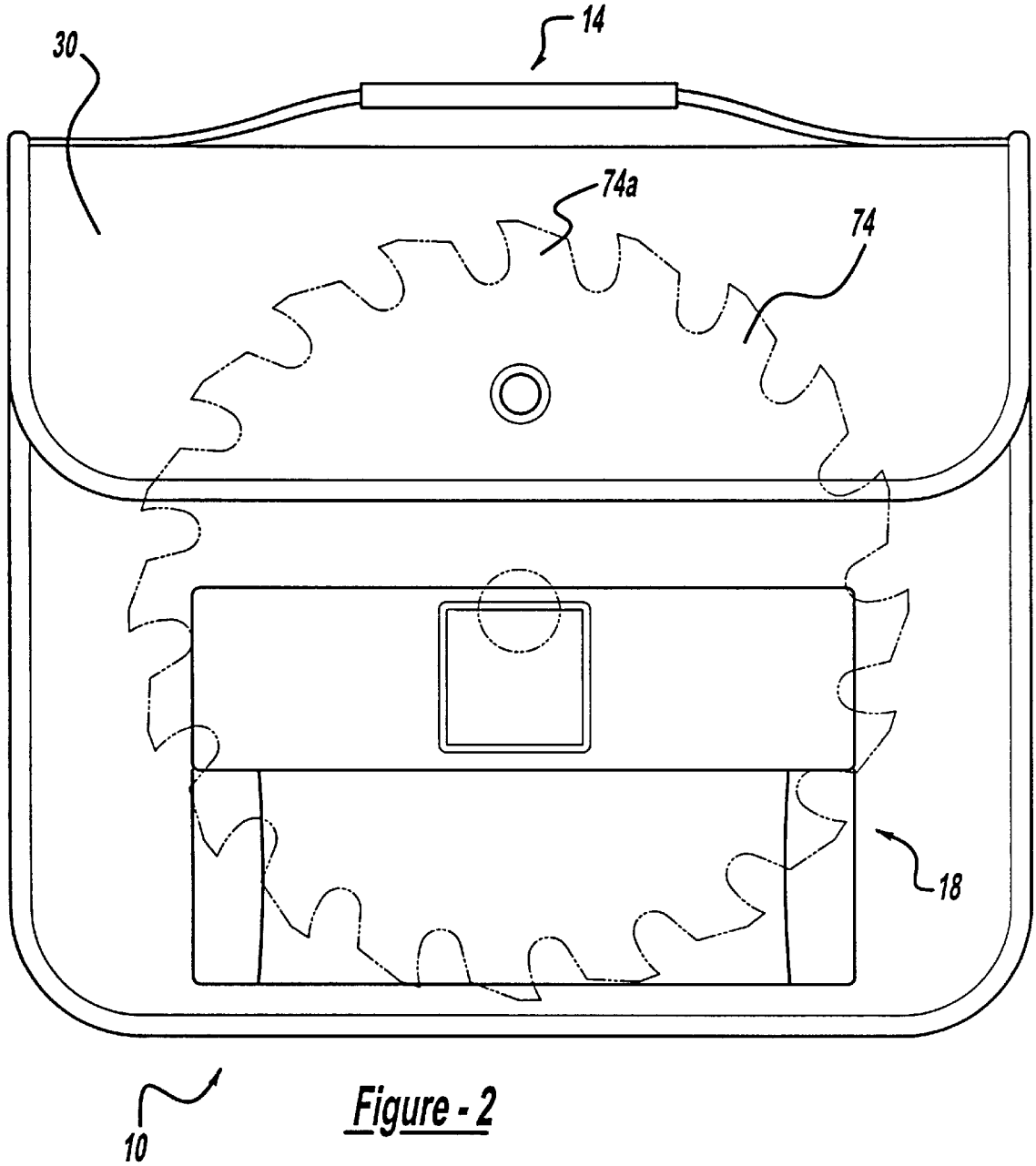
FIG. 2 is a front view of the case of FIG. 1 illustrating an article as stored in one of the first pouches.

Each of the pouch members 70 is preferably fixedly coupled to rear panel 34 along their bottom and side edges and sized to permit their respective first pouch 16 to accommodate a wide variety of items, such as circular saw blades 74 as shown in FIG. 2. First pouches 16 are sized in this particular example to store saw blades 74 in a confined manner to prevent them from being damaged during the transport or use of case 10.

The teeth 74*a* of saw blades 74 tend to slide along the surface of suede rather than cut into it and as such, the use of suede on the interior surfaces of first pouches 16 permits saw blades 74 to be readily inserted to and removed from case 10 without damaging rear panel 34 or pouch members 70. To further enhance the convenience of case 10, the first pouches 16*a*, 16*b* and 16*c* are preferably staggered vertically with respect to one another to space saw blades 74 vertically apart to permit them to be stored and removed in a convenient and expedient manner.

Case 10 also includes a mounting structure 80 to permit case 10 to be opened and coupled to an external mounting member (not shown), such as a nail, a screw, a pipe, a pole, a rope or a cable. In the particular example illustrated, mounting structure 80 is a grommet 82 which is fixedly coupled to closure panel 30. Grommet 82 includes an aperture 84 which a nail may be positioned through. By way of this construction, case 10 may be readily removed and repositioned from workstation to work station as desired.

In the example provided, handle portion 14 is fixedly secured to spacer panel 32 by a plurality of rivets 62. Handle portion 14 includes an elongated fabric handle member 90 and a gripping member 92 coupled thereto to facilitate the transport of case 10 in a comfortable and ergonomic manner. Alternatively, handle portion 14 may be releasably coupled to spacer panel 32 to permit handle member 90 to be removed as desired.

Case 10 also preferably includes a second pouch 18 which is coupled to the outer surface of pouch member 70*c* below quick release fastener 50. Second pouch 18 is formed by a closure member 100, a pouch member 70*c* and an outer pouch member 102. Second pouch 18 is conveniently sized and located for quick and easy access to a blade wrench or other tool accessories. The sides of outer pouch member 102 are fixedly coupled to the outer surface of pouch member 70*c*. Outer pouch member 102 preferably includes "accordioned" expandable and contractible sides 104 which permit second pouch 18 to volumetrically expand in a desired manner.

Preferably, closure member 100 and outer pouch member 102 are formed from a material such as polyolefin. Closure member 100 and pouch member 70*c* are preferably stitched together along their abutting edge to form a living hinge 106 which permits closure member 100 to be moved between a closed position as shown in FIG. 1 and an open position as shown in FIG. 4. In order to provide a neat appearance and increased durability, the non-abutting edges of closure member 100 are banded by an edging fabric 108 as shown in FIG. 1, with the edging fabric 108 being composed of nylon, imitation nylon or other suitable and durable nylon-type fabric materials.

A quick-release fastener 110 is provided on the inner surface 112 of closure member 100 and the outer surface 114 of outer pouch member 70*c* to permit second pouch 18 to be releasably retained in its closed configuration. Quick-release fastener 110 is illustrated as being a hook-and-loop type fastener assembly but may also be any other fastener, such as a snap-type fastener.

As illustrated in FIG. 3, case 10 also preferably includes a third pouch 20 coupled to the outer surface of rear panel 34. Third pouch 20 is formed by the outer surface 40 of rear panel 34 and a cover structure 120 having a suede frame 122 and a plastic cover member 124. Third pouch 20 is preferably sized to receive a business card 126 which permits case 10 to be identified to a particular user. Identification in this manner guards against the loss of case 10 and also permits case 10 to be delivered to third parties so that saw blades 74 may be resharpened and returned to the proper user.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

I claim:

1. An article carrier having a first body panel, a spacer panel and a second body panel to which at least one pocket member is coupled, the pocket member forming a pocket having an open end and adapted to retain an article, the spacer panel disposed between the first and second body panels, the spacer panel and first and second body panels being foldably interconnected in order to allow selective movement of the first and second body panels relative to the spacer panel between an open position and a closed position, said first and second body panels including an outer surface formed from a first material, wherein the first and second body panels are substantially parallel to each other and spaced apart a predetermined distance defined by the spacer panel and the first body panel covers at least a portion of the pocket member to retain the article in the pocket when the article carrier is placed in the closed position and said pocket includes first and second surfaces formed from a second material different from said first material and said second material enabling easy ingress and egress of articles in said pocket without damaging said first and second panels.

2. The article carrier of claim 1, further including a quick-release fastener for releasably securing the first body panel to one of the pocket members.

3. The article carrier of claim 2, wherein the quick-release fastener is a hook-and-loop fastener.

4. The article carrier of claim 2, wherein the quick-release fastener is a snap-type fastener.

5. The article carrier of claim 1, further including a releasably closable exterior pocket coupled to an exterior surface of one of the at least one pocket members.

6. The article carrier of claim 5, wherein the releasably closable exterior pocket includes accordioned expandable and retractable sides.

7. The article carrier of claim 1, further including a pocket coupled to an exterior surface of the second body panel, the pocket adapted to receive a business card.

8. The article carrier of claim 1, wherein the spacer panel is reinforced by a stiffener member, the stiffener member being spaced apart from the first and second body panels to form a foldable hinge therebetween.

9. The article carrier of claim 1, further including a handle member coupled to the spacer panel.

10. The article carrier of claim 9, wherein the handle member is fixedly coupled to the spacer panel by a plurality of rivets.

11. The article carrier of claim 1, wherein the pocket first and second surfaces are formed from a suede material.

12. The article carrier of claim 11, wherein an interior surface of the second body panel is formed from a suede material.

13. The article carrier of claim 12, wherein an interior surface of the first body panel is formed from a suede material.

14. The article carrier of claim 1, further including a mounting structure coupled to one of the first and second body panels and adapted to be releasably mounted onto an external mounting member.

15. The article carrier of claim 14, wherein the mounting structure is a grommet coupled to the first body panel.

16. The article carrier of claim 14, wherein the external mounting member is any one of a group of external mounting members including a nail, a screw, a pipe, a pole, a rope and a cable.

17. The article carrier of claim 1, wherein the outer surface of the first and second body panels is formed from a polyolefin material.

18. The article carrier of claim 1, wherein the article is a circular saw blade.

19. An article carrier having a first body panel, a spacer panel, a second body panel and first pocket member and a second pocket member, the first and second body panels each including an interior surface formed from a suede material and an exterior surface formed from a material different from said suede material, the first pocket member having a suede material on an interior surface, the second pocket member having a suede material on first and second surfaces, the first and second pocket members coupled to the second body panel and forming first and second pockets, respectively each having an open end and adapted to retain an article, the second pocket member abutting the second body panel and the first pocket member abutting the second pocket member, the spacer panel disposed between the first and second body panels, the spacer panel and first and second body panels being foldably interconnected in order to allow selective movement of the first and second body panels relative to the spacer panel between an open position and a closed position, wherein the first and second body panels are substantially parallel to each other and spaced apart a predetermined distance defined by the spacer panel and the first body panel covers at least a portion of the pocket member to retain the article in the pocket when the article carrier is placed in the closed position.

20. The article carrier of claim 19, wherein the open ends of the first and second pockets are spaced axially apart from one another.

* * * * *